US005337670A

United States Patent [19]

Huang

[11] Patent Number: 5,337,670

[45] Date of Patent: Aug. 16, 1994

[54] PROCESS FOR THE TRANSFER PRINTING OF A GULF CLUB HEAD

[76] Inventor: Chung Ming Huang, P.O. Box 82-144, Taipei, Taiwan

[21] Appl. No.: 178,423

[22] Filed: Jan. 6, 1994

[51] Int. Cl.[5] ..... B41F 23/04; A63B 53/04

[52] U.S. Cl. ..... 101/487; 101/34; 273/167 R

[58] Field of Search ..... 101/487, 483, 35, 34, 101/33; 273/167 R, 186.4, 187.6; 156/384–387, 383

[56] References Cited

U.S. PATENT DOCUMENTS

| | | | |
|---|---|---|---|
| 2,660,436 | 11/1953 | Grossman | 273/186.4 |
| 3,061,882 | 11/1962 | Wolinski | 101/487 |
| 4,059,471 | 11/1977 | Haigh | 101/34 |
| 5,104,457 | 4/1992 | Viljoen et al. | 273/167 R |
| 5,171,621 | 12/1992 | Desbiolles et al. | 273/167 R |

FOREIGN PATENT DOCUMENTS

| | | | |
|---|---|---|---|
| 049108 | 8/1991 | Japan | 273/167 R |

*Primary Examiner*—Edgar S. Burr
*Assistant Examiner*—Anthony H. Nguyen
*Attorney, Agent, or Firm*—Alfred Lei

[57] ABSTRACT

A process for the transfer printing of a golf club head including steps of forming a golf club head, polishing the golf club head with sand blast which consists of particles of sand, powdered quartz, chilled iron globules, emery, or other hard granular material blown by a jet of compressed air, spraying paint on the golf club head thereby forming a layer of paint on the surface thereof, placing the golf club head into a furnace for baking for fixing the paint thereon, cooling the golf club head thus forming a semi-product, covering the golf club head with a piece of mold paper, and disposing the golf club head in a steam furnace at 260 degrees centigrade for 10 minutes hence causing the ink pattern on the mold paper to be printed on the paint of the golf club head consequently producing a golf club head with desired patterns thereon.

1 Claim, 3 Drawing Sheets

PROCESS FOR THE TRANSFER PRINTING OF A GULF CLUB HEAD

BACKGROUND OF THE INVENTION

Golf is a game of hitting a small hard ball with golf clubs over an outdoor course sometimes called a links. The object is to deposit the ball in a specified number of cups, or holes, using as few strokes as possible. A complete set of golf clubs consists of four woods, used for long drives, ten irons, used for shorter shots, and a putter, used for the short distances on the green. However, the pattern on the head of such golf clubs is easily removed in impact.

Therefore, it is an object of the present invention to provide a process for the transfer printing of a golf club head which may obviate and mitigate the above-mentioned drawbacks.

SUMMARY OF THE INVENTION

This invention relates to a process for the transfer printing of a golf club head.

It is the primary object of the present invention to provide a process for the transfer printing of a golf club head on which the pattern is bonded securely.

It is another object of the present invention to provide a process for the transfer printing of a golf club head which is easily carried out.

It is still another object of the present invention to provide a process for the transfer printing of a golf club head which is fit for practical use.

It is still another object of the present invention to provide a process for the transfer printing of a golf club head which is durable in use.

It is a further object of the present invention to provide a process for the transfer printing of a golf club head which has been developed to reach the stage of industrial utilization.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1:
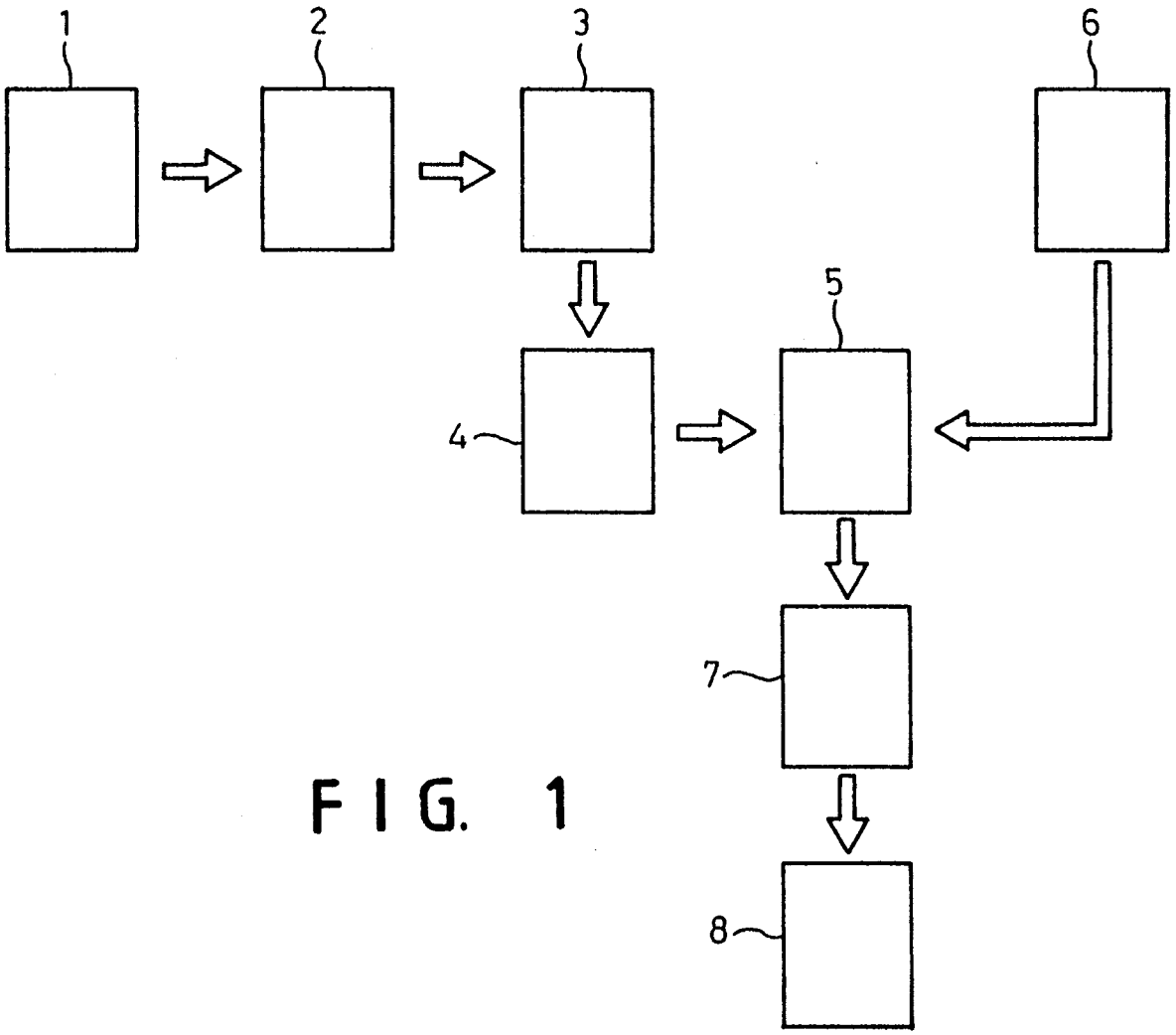
FIG. 1 is a flow chart of the present invention.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
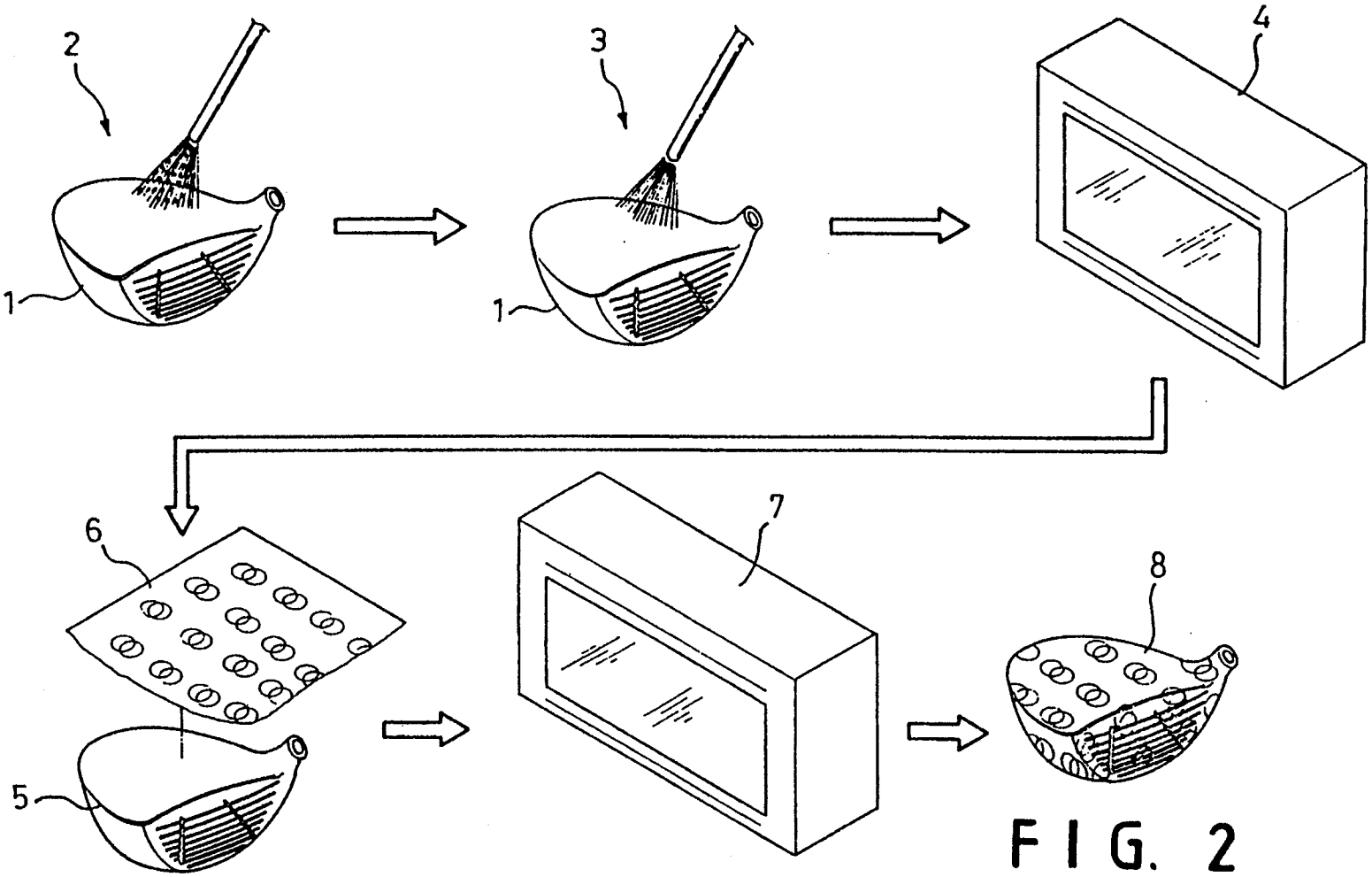
FIG. 2 shows the process of the present invention.
Figure 4:
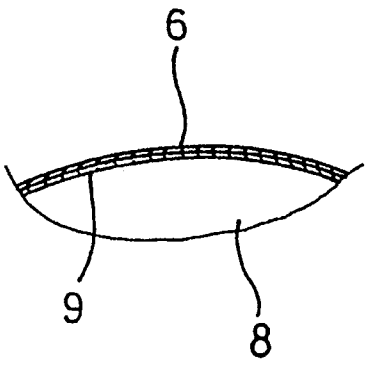
FIG. 4 is a sectional fragmentary view of the golf club head.
Figure 3:
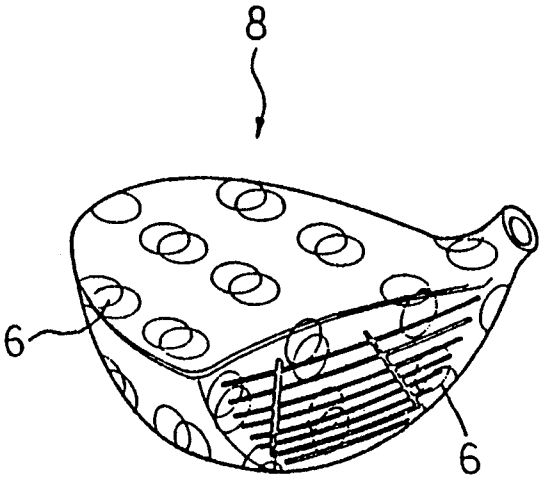
FIG. 3 is a perspective view of the golf club head.

With reference to the drawings and in particular to FIGS. 1 and 2 thereof, the process of forming pattern on the surface of a golf club head according to the present invention comprises the steps of:

1. forming a golf club head 1;
2. polishing the golf club head 1 with sand blast 2 which consists of particles of sand, powdered quartz, chilled iron globules, emery, or other hard granular material blown by a jet of compressed air;
3. spraying paint 3 on the golf club head 1 thereby forming a layer of paint 9 on the surface thereof;
4. placing the golf club head 1 into a furnace 4 for baking for fixing the paint 9 thereon;
5. cooling the golf club head 1 thus forming a semi-product 5;
6. covering the golf club head 1 with a piece of mold paper 6 having an ink pattern thereon; and
7. disposing the golf club head 1 in a steam furnace 7 at 260 degrees centigrade for 10 minutes hence causing the ink pattern on the mold paper 6 to be printed on the paint 9 of the golf club head 1 consequently producing a golf club head 8 with desired patterns thereon.

Through numerous experiments on the golf club head with pattern manufactured according to the present invention, it has been found that the pattern thereon will remain intact even after colliding with the golf-ball for a large number of times.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention, This invention accordingly includes all the means constituting technical equivalents of the means described as well as their combinations.

I claim:

1. A process for the transfer printing of a golf club head comprising steps of:

forming a golf club;

polishing the golf club head 1 with sand blast which consists of particles of sand, powdered quartz, chilled iron globules, emery, or other hard granular material blown by a jet of compressed air;

spraying paint on the golf club head thereby forming a layer of paint on the surface thereof;

placing the golf club head into a furnace for baking for fixing the paint thereon;

cooling the golf club head thus forming a semi-product;

covering the golf club head with a piece of mold paper having an ink pattern thereon; and disposing the golf club head in a steam furnace at 260 degrees centigrade for 10 minutes hence causing the ink pattern on the mold paper to be printed on the paint of the golf club head consequently producing a golf club head with desired patterns thereon.

* * * * *